United States Patent [19]

McMurray

[11] Patent Number: 4,884,988

[45] Date of Patent: Dec. 5, 1989

[54] INTERCONNECTING BUILDING TOY PANELS

[76] Inventor: Larry D. McMurray, 14421 29th Ave., S., Seattle, Wash. 98168

[21] Appl. No.: 255,846

[22] Filed: Oct. 11, 1988

Related U.S. Application Data

[63] Continuation-in-part of Ser. No. 130,162, Dec. 8, 1987, abandoned.

[51] Int. Cl.[4] ..... A63H 33/08; A63H 3/52; A47G 5/00

[52] U.S. Cl. ..... 446/115; 446/478; 446/901; 160/135; 52/DIG. 13

[58] Field of Search ..... 446/115, 116, 112, 111, 446/109, 108, 85, 120, 476, 478, 487, 901; 160/135; 24/446, 442; 52/DIG. 13

[56] References Cited

U.S. PATENT DOCUMENTS

| | | | |
|---|---|---|---|
| 3,387,345 | 6/1968 | Savoir | 24/446 |
| 3,777,435 | 12/1973 | Perina | 52/DIG. 13 X |
| 4,047,337 | 9/1977 | Bergstrom | 160/135 X |
| 4,212,130 | 7/1980 | Walker | 446/111 |
| 4,635,418 | 1/1987 | Hobgood | 52/DIG. 13 X |

FOREIGN PATENT DOCUMENTS

| | | | |
|---|---|---|---|
| 688793 | 6/1964 | Canada | 446/478 |
| 2102602 | 7/1971 | Fed. Rep. of Germany | 24/446 |
| 2373312 | 7/1978 | France | 446/478 |
| 69058 | 3/1930 | Sweden | 446/478 |

*Primary Examiner*—Robert A. Hafer
*Assistant Examiner*—D. Neal Muir
*Attorney, Agent, or Firm*—Mark Zovko

[57] ABSTRACT

A creative building playtoy for children which allows rapid interlocking and disconnecting. A plurality of panels is provided to form the basic building blocks. Each panel has edging strips which have a unique fastening cloth on their exterior surface. The fastener cloth is comprised of a base fabric with cloth hooks and loops interspersed thereon to allow rapid manual connecting and disconnecting of the edging strips of the panels so that various complex forms can be produced by the child.

8 Claims, 4 Drawing Sheets

INTERCONNECTING BUILDING TOY PANELS

CROSS RELATION TO OTHER U.S. APPLICATIONS

This application is a continuation-in-part of application Ser. No. 130,162, filed 12/8/871, now abandoned.

BACKGROUND OF THE INVENTION

1. Field of the Invention

This invention relates generally to playtoys for children and more particularly to a system of panels with edging strips which can be easily and rapidly connected to each other by hand so as to produce complex building forms.

2. Discussion of the Prior Art

Various children's toys have been provided to develop and express a child's creative building desires. From simple wooden blocks to various rather complex connecting devices, the toy market has a substantial section devoted to the expression of children's ideas in a physical form. Various means of connecting individual pieces have surfaced including mere compression, nuts and bolts, screws, latches, etc. These building playtoys appeal to all ranges of children beginning at the toddler stage on up to adolescence.

Of the variety of toys in the building category, perhaps the closest to the present invention is the interlocking blocks that are well known in the toy market. These blocks are usually shaped like small bricks and have a face with small pegs protruding therefrom and on the reverse side have space matching the pegs so as to permit interconnecting the individual pieces of the toy. While these toys are enjoyed by many children, they have some disadvantages relative to the represent invention. First, they require a relative greater effort to connect and especially disconnect. Also, the individual pieces are sometimes small and could be swallowed by a child inadvertently. Further, there is normally only one 'proper' way to assemble the individual pieces to each other and thus requires a higher degree of skill and manual dexterity compared to the present invention. For example, some toys have male parts which mate with different female parts. The present invention therefore provides an interlocking array of panels which can be arranged in various creative complex forms easily and rapidly by even toddlers in a safe manner. The panels are all attachable to each other and the user need not search for a particular mate to a given piece.

SUMMARY OF THE INVENTION

The present invention includes an interconnecting playtoy for children which uses preformed panels of a suitable size and shape. The panels are made from a rigid material such as standard cardboard or plastic and panels can be similar in shape or dissimilar. An edging strip having an interior slot is adapted to fit over the edges of the panels, the edging strips have an exterior surface which has a unique fastener cloth material attached thereto. The fastener cloth is comprised of a hook material having a base overlaid with a softer loop type material which is compressed over and into the hook material. The loop material can be attached to the base by glue or by weaving the loop material through the reverse side of the hook material similar to what is done in the carpet manufacturing art. Bonding of two surfaces having fastener cloth thereon is accomplished when hooks of the hook material of one surface engage loops of the other surface and interlock. The fastener cloth of one edging strip can be attached to the fastener cloth of one or more other edging strips on different panels so that panels may be interconnected along their edges to form play structures. Unlike the conventional fastening means, the present invention allows multiple connections at one edge with any other edge or edges having the fastener cloth thereon.

It is an object of the present invention, therefore, to provide a child's playtoy which consists of a network of interconnecting panels which can be connected to each other and produce a complex form.

A further object of the present invention is to provide a creative playtoy for children which can be manufactured relatively inexpensively.

Another object of the present invention is to provide a series of panels can be easily connected and disconnected by very young children with 100% connection rate regardless of alignment.

Still another object of the present invention is to provide a child's creative playtoy which is relatively safe for all children.

Another object of the present invention is to provide a durable, virtually unbreakable toy for children.

Still another object of the present invention is to provide a toy that is light weight, non-annoying and portable that can be conveniently used in vehicles by children, as well as around sand and water play areas.

Yet another object of the present invention is to provide an interconnecting toy in which individual pieces are all interconnectable.

These and other objects and advantages of the present invention can be more fully understood by the following description when taken in conjunction with the attached drawings.

DESCRIPTION OF THE PREFERRED EMBODIMENT OF THE INVENTION

Figure 2:
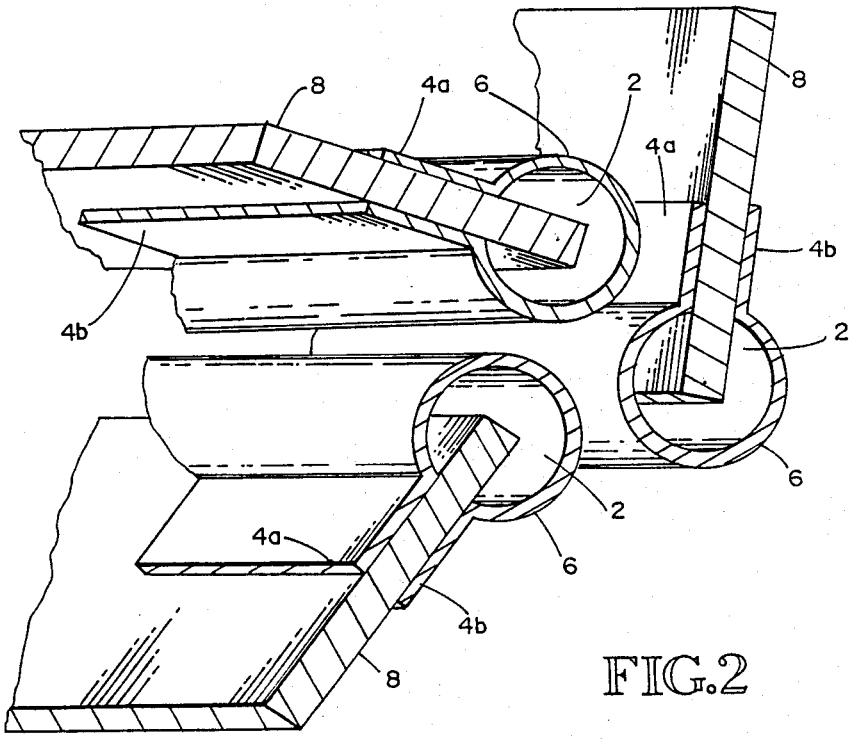
FIG. 2 is a partial sectional view of three panels having edging strips in perspective.
Figure 3:
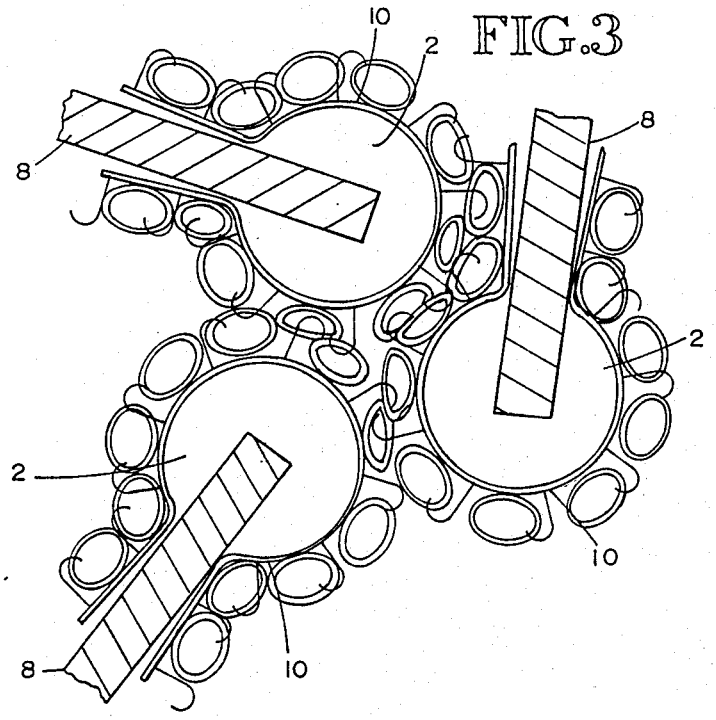
FIG. 3 is a sectional view of three panels having edging strips overlaid with the fastener cloth of the present invention.

Referring to the FIGS. 2 and 3, an edging strip 2 is shown. Edging strip 2 is a double flanged strip made preferably of a plastic material, having flanges **4*a* and 4*b* with a 270° circular section 6. The edging strips 2 are fastened over the edges of panels 8 made to a predetermined thickness and shape. Over the circular sections 6** of edging strips 2 a unique fastener cloth material 10 is attached, preferably with glue or the like. The fastener cloth material 10 would cover substantially all of the outer surface area of circular section 6 and the formation of this material will be described subsequently.

Figure 4A:
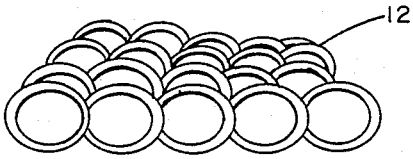
FIG. 4A shows a perspective view of the loop material of the present invention.
Figure 4B:
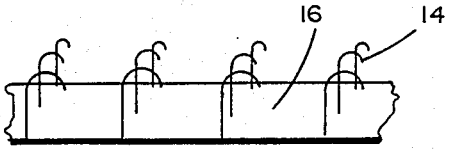
FIG. 4B shows a perspective view of the hook material used in the present invention.
Figure 4C:
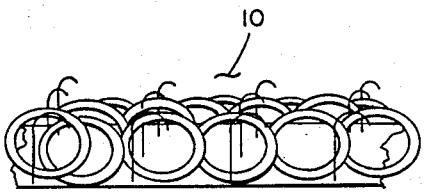
FIG. 4C shows a perspective view of the hook material overlaid with the loop material as used in the present invention.
Figure 5:
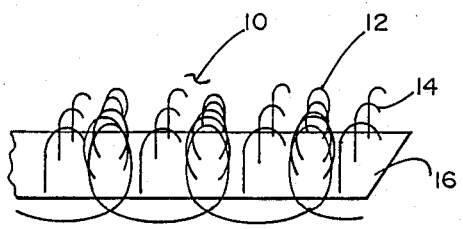
FIG. 5 is a perspective view which shows a hook type material with a loop material woven through its base.

FIGS. 4A, 4B, and 4C show one way to form the fastener cloth 10 of the present invention. In FIG. 4A, a loop cloth 12 is shown which combines with the hook material 14 having base 16 shown in FIG. 4B to form the fastener cloth 10 of FIG. 4C. The loop cloth 12 is softer and finer relative to the hook material 14. Hook material 14 is somewhat stiff but still flexible. When loop cloth 12 and hook material 14 are assembled, the resulting fastener cloth 10 is shown in FIG. 4C. The loop material 12 may be bonded with glue or the like to the base 16 of hook material 14. Alternatively, the loop material 12 may be sewn to the base 16 of the hook material 14. FIG. 5 shows a fastener 10 which was formed in yet another way by weaving the loop material 12 into the base 16 of the hook material 14 as done in carpet manufacturing. It should be noted that the important feature of the fastener cloth 10 is its fastening and unfastening advantages and not the specific method of its manufacture.

Figure 6:
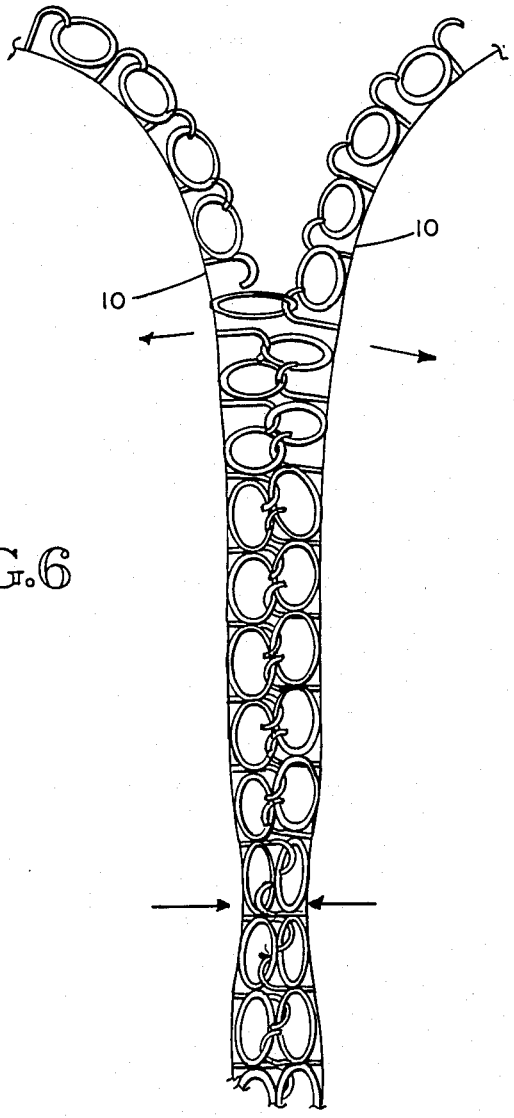
FIG. 6 is a sectional view showing the bonding of two pieces of hook and loop cloth as used in the present invention.

FIG. 3 shows what happens when several edging strips 2 having fastener cloth 10 attached thereto are joined. The loops of cloth 10 are soft and flexible which allows them to compress when loops from and opposing cloth material 10 are pressed upon them The hooks of the cloth 10 are more rigid in comparison and penetrate beyond the collapsed loops when forced upon an opposing cloth 10. Upon removal of the compressive stress, the hooks mate with opposing loops as best shown in FIGS. 3 and 6.

Figure 1:
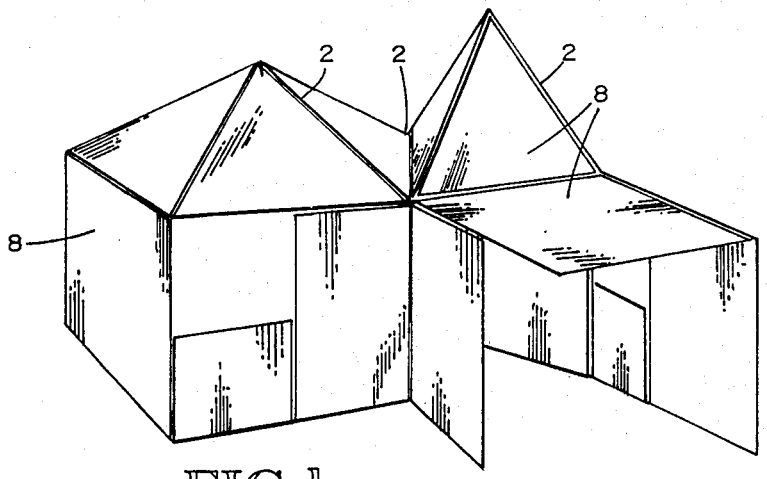
FIG. 1 is a perspective view of a plurality of panels interconnected using the edging strips of the present invention.

When a panel 8 having the edging strip 2 with fastener cloth 10 is contacted with the edge of a similar edging strip 2, a bonding surface is created. Creative structures, such as that shown in FIG. 1, can be built by a child very easily taking advantage of the rapid bonding of the edging strips which can be attached to the edge of any suitable panel material. It should be pointed out that the present bonding material composed of a fastener cloth 10 as described above has a mating capability not present in conventional hook and cloth material. Typically in conventional fastening material such as hook and loop cloth, one whole edging strip would have to be hook cloth and another whole edging strip loop cloth. Obviously loop to loop bonding wouldn't work and hook to hook bonding would be impractical for the purpose of this invention. Alternate sections of non-uniform length, random pattern hook and loop cloth could be used on an edging strip 2 of the present invention, but the above described two layer material has an advantage over conventional hook and loop cloth in that it produces a more easily separable bonding, enabling young children to more easily build and take apart structures using the edging strips on panels. Further, the two layers of the present invention can be softer than the conventional hook and loop cloth if the loops of the fastener cloth 10 have a diameter equal to the height of the hooks, making it safer for young children's use.

The invention may be embodied in other forms without departing from the spirit or essential characteristics thereof. The present embodiments are therefore to be considered in all respects as illustrative and not restrictive, the scope of the invention being indicated by the appended claims rather than the foregoing description, and all change which comes within the meaning and range of equivalency of claims are intended to be embraced therein.

What is claimed is:

1. Apparatus for interconnecting panels to form play structures comprising panels having edges, said panels having edging means, attached to the edges of the panels, said edging means having a flange portion and a cylindrical portion connected to said flange portion, said flange portion having an interior slot receiving the edge of a panel and with attachment means affixing said edging means to said edges, said edging means having an exterior surface, said exterior surface having a hook cloth material attached thereto, said hook cloth material overlaid with a loop material, said loop material being attached to said hook cloth material whereby said hook cloth material and loop material of one edging means is attachable to said hook and loop material of the edging means of another panel so that panels may be interconnected to form play structures.

2. The apparatus of claim 1 wherein said flange portion of said edging means has two flanges.

3. The apparatus of claim 1 wherein said circular portion of said edging means extends greater than 180° degrees.

4. The apparatus of claim 1 wherein said circular portion of said edging means extends for substantially 270° degrees.

5. Apparatus for interconnecting panels to form play structures comprising panels having edges, said panels having edging means attached to the edges of the panels, said edging means having a flange portion and a cylindrical portion connected to said flange portion, said flange portion having an interior slot receiving the edge of a panel and with attachment means affixing said edging means to said edges, said edging means having an exterior surface, said exterior surface having a hook and loop cloth material attached thereto whereby said hook and loop cloth material of one edging means is attachable to said hook and loop cloth material of the edging means of another panel so that panels may be interconnected to form play structures.

6. The apparatus of claim 5 wherein said flange portion of said edging means has two flanges.

7. The apparatus of claim 5 wherein said circular portion of said edging means extends greater than 180° degrees.

8. The apparatus of claim 5 wherein said circular portion of said edging means extends for substantially 270° degrees.

* * * * *